United States Patent [19]

Clement

[11] 4,079,479

[45] Mar. 21, 1978

[54] SLIDING DOOR CLOSURE AND LOCKING MECHANISM

[76] Inventor: Clyde H. Clement, 8439 N. 13th Pl., Phoenix, Ariz. 85020

[21] Appl. No.: 830,783

[22] Filed: Sep. 6, 1977

[51] Int. Cl.[2] ..... E05I 3/00

[52] U.S. Cl. ..... 16/66; 49/449; 16/84

[58] Field of Search ..... 49/386, 139, 404, 449; 16/66, 71, 49, 84, 86.2, 51, 87

[56] References Cited

U.S. PATENT DOCUMENTS

| | | | |
|---|---|---|---|
| 533,075 | 1/1895 | Mohn | 16/86.2 |
| 1,986,948 | 1/1935 | Ulm | 16/86.2 |
| 2,835,487 | 5/1938 | Clark | 49/139 |
| 3,278,979 | 10/1966 | Clement | 16/66 |
| 3,698,883 | 10/1972 | Fazio | 49/449 |

*Primary Examiner*—Ronald Feldbaum
*Attorney, Agent, or Firm*—Drummond, Nelson & Ptak

[57] ABSTRACT

A closure for sliding arcadia doors utilizes a pair of telescoping tubes biased to their telescoped or closed position by an internal interconnecting tension spring and employs a pneumatic system and a bleeder valve to control the rate of closing or telescoping of the tubes once they have been opened against the bias of the tension spring. A locking mechanism uses a locking bar and a pair of brackets, one connected to the corner of the door frame and the other mounted on the door for movement with it, (1) to lock the door closed, (2) permit the door to be opened using the door closer so that it is automatically closed by the closer, or (3) to permit the door to be used in its normal manner as if the door closer was not present.

9 Claims, 6 Drawing Figures

SLIDING DOOR CLOSURE AND LOCKING MECHANISM

BACKGROUND OF THE INVENTION

Sliding doors such as arcadia doors are widely used in homes, apartment buildings, and many commercial establishments, particularly for use as patio doors or the like. These doors offer the advantage of a wide expanse of glass and, since they do not swing inwardly or outwardly, do not intrude upon the space on either side of the door which then can be utilized in any manner desired. A disadvantage of such doors is that once they are opened, they require a positive effort to reclose. This is particularly disadvantageous for home owners with small children who typically forget it reclose the door after they open it and pass through it.

Door closers which automatically close sliding or arcadia doors have been developed to automatically reclose such doors after they have been opened. Most of these door closers are bulky and unattractive, so that they have not proved popular in home and apartment applications in particular.

A compact and effective sliding door closer which does not have the unslightly bulk of typical closers is disclosed in my prior U.S. Pat. No. 3,278,979 issued Oct. 18, 1966. While the closer disclosed in this patent effectively operates to automatically reclose sliding doors after they have been opened and permits a simple adjustment of the rate of closure, the locking of the door and maintaining the door in a partly open condition required the operation of a thumb screw. While the thumb screw was effective to accomplish the desired purpose, it was relatively inconvenient to use and did not provide as strong a lock for the door in the fully closed position as is now desirable.

Accordingly, it is desirable to provide an improved sliding door closer which may be securely locked in the closed position, operated with the automatic closer mechanism functioning, or operated as a normal sliding door without any action from the closer whatsoever. It is desirable that these three different modes of operation may be readily selected and controlled one to the other simply and effectively.

SUMMARY OF THE INVENTION

Accordingly, it is an object of this invention to provide an improved automatic door closer for sliding doors.

It is another object of this invention to provide an automatic door closer which may be readily changed from an automatic operation to a conventional operation and back again.

It is an additional object of this invention to provide an improved lock for a sliding door.

It is a further object of this invention to provide a sliding door closer and lock combination which is compact and simple to install.

In accordance with a preferred embodiment of the invention, a sliding door closer comprises inner and outer mutually telescoping tubes which are movable between closed and extended positions. A spring is attached under tension between the tubes to bias them to the closed position. A first bracket is attached to the corner of the frame in which a sliding door slides and a second bracket is secured to the mating corner of the sliding door and to one end of the outer tube of the two telescoping tubes. The inner telescoping tube has an extension on it which extends beyond the one end of the outer tube and this extension has a latch engaging hole in it. In order to effect three different modes of operation of the door, a locking device is employed for selectively (1) interlocking at least the first and second brackets together to lock the door in a closed position, (2) interlocking at least the first bracket and the latch engaging member on the extension means on the inner tube to permit operation of the door utilizing the automatic closure feature or (3) permitting independent movement of the second bracket and the latch engaging member relative to the first bracket, so that the door can be used in a conventional manner as if the closer mechanism were not present.

DETAILED DESCRIPTION OF THE PREFERRED EMBODIMENT

Figure 1:
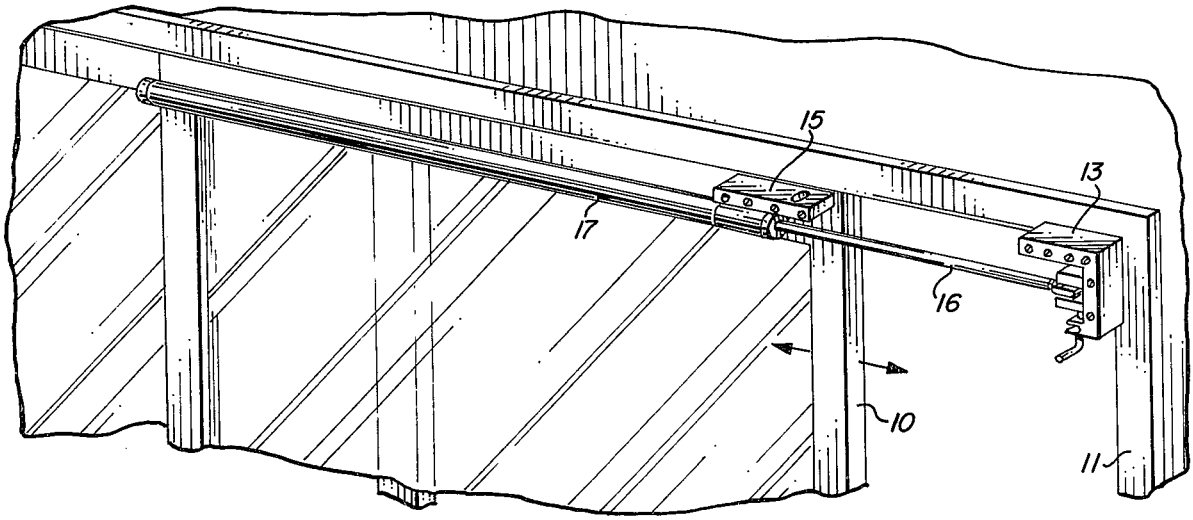
FIG. 1 is a partial perspective view of a typical sliding door which has the closer mechanism of a preferred embodiment of the invention attached to it and to the door frame.

In the drawings, the same reference numbers are used throughout the several figures to designate the same or similar components.

Referring now to FIG. 1, there is shown a typical sliding arcadia door 10 mounted for sliding movement in a frame 11. The hardward comprising the door closure and locking device in accordance with a preferred embodiment of the invention is illustrated by a first bracket 13 attached to the upper right-hand corner of the frame 11 and a second bracket 15 attached to the door 10 at its upper edge and adjacent the right-hand edge as viewed in FIG. 1. The brackets 13 and 15 then cooperate with an inner tube 16 and an outer tube 17 which are mounted in a telescoping relationship to comprise the primary parts of the automatic door closure.

Figure 2:
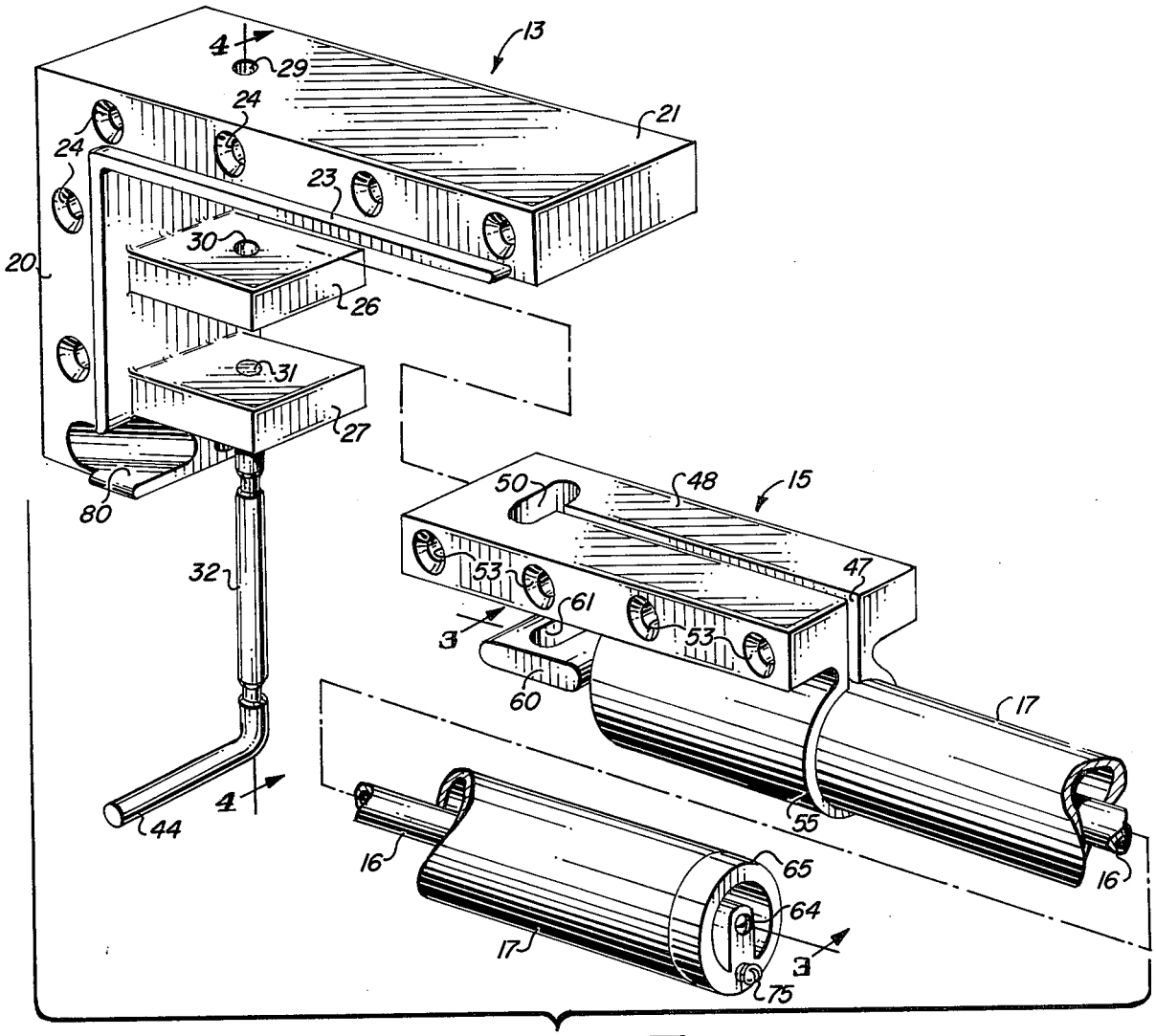
FIG. 2 is an exploded view of details of the embodiment shown in FIG. 1.

Referring now to FIG. 2, the details of the brackets 13 and 15 along with portions of the details of the telescoped inner and outer tubes 16 and 17, respectively, are shown. The corner bracket 13 is a generally E-shaped bracket with a vertical portion 20 and an upper horizontal leg 21 which fits into the corner of the frame 11 on either the right-hand or left-hand side in accordance with the direction of opening of the door 10.

To properly align the bracket 13 into the corner of the door frame, an L-shaped flange 23 (one of which is on each side of the bracket 13) extends into the corner of the frame 11 and locates the sides of the portions 20 and 21 adjacent the corner of the frame 11. When the bracket 13 is in this location, as shown most clearly in FIG. 1, screws are inserted through six holes 24 extending through the leg 21 and the vertical portion 20 to mount the bracket 13 firmly into the corner in which it is placed. As most clearly shown in FIG. 2, the bracket 13 includes a central leg 26 and a lower leg 27 extending outwardly from the vertical portion 20 parallel with the upper leg 21.

A series of aligned holes 29, 30 and 31 are formed through the legs 21, 26 and 27, respectively, of the bracket 13 to accommodate the vertical travel of a locking rod 32 through them. The alignment of these holes and the configuration of the rod 32 is shown most clearly in FIGS. 4 and 5.

The locking rod 32 is vertically movable to any one of three detented positions which are established by three detents or indentations 34, 35 and 36, on the rod. The upper end of the rod 32, the lower edge of the indentation 36, and the edges of the indentations 34 and 35 all are beveled to form cam surfaces to act in conjunction with a spring biased follower 37 located in a passageway through the portion 20 and extending through the lower leg 27 to the hole 31 in the leg 27.

In assembling the locking rod 32 into the bracket 13, the locking rod 32 is first inserted into a position extending through the leg 27 past the passageway in which the follower 37 is inserted. Then the follower 37 is inserted into the passageway, a spring 40 is placed in the passageway behind the follower 37 and a plug 41 compresses the spring 40 and closes the passageway through the vertical portion 20 of the bracket 13. Once the plug 14 is in place, it is brazed or glued to hold it securely in this permanent position.

To prevent accidental removal of the locking rod 32 after the follower 37 and spring 40 are in place, the upper edge of the indentation 36 is cut straight across, that is it is not a cam surface. The corresponding edge of the follower cylinder 37 also is essentially a nonbeveled edge; so that when the locking lever 32 is pulled to its lowermost position causing the follower 37 to press into the indentation 36, the abrupt lip of the upper edge of the indentation 36 engages the side of the cylindrical follower 37 and prevents further downward travel of the locking bar 32. Upward travel of the locking bar 32 is limited by the handle portion 44 which extends substantially at right angles to the rod 32, as seen most clearly in FIG. 2.

Once the bracket 13 is attached to the corner of the frame in which the sliding door slides and the locking bar 32 is in place as described above, the locking bar may be moved vertically to any one of its three detented positions. In the lowermost position with the follower 37 in the detent 36, the locking bar is entirely within and below the leg 27 of the bracket 37. Thus, the space between the legs 21 and 26 and between the legs 26 and 27 is free of the locking bar. In its center detented position, with the follower 37 in the detent 35, the upper end of the locking bar 32 is within the leg 36 in the hole 30; so that the locking bar 32 passes through the space between the legs 26 and 27. In this position, however, the space between the legs 21 and 26 still is open. In the uppermost position of the locking bar 32, with the follower 37 in the detent 34, the locking bar is in the dotted line position illustrated in FIG. 4 with the upper end located within the upper leg 21 of the bracket 13. In this position, the locking bar passes through the spaces between all of the legs of the bracket 13.

Reference now should be made back to FIGS. 1 and 2 which illustrate the details of the mounting bracket 15 attached to the door and to the outer tube 17 of the door closer. The bracket 15, as shown most clearly in FIG. 2, is partially bifurcated by a slot 47 in its upper horizontal leg 48. The bifurcation 47 terminates in a key-shaped slot 50 located near the left-hand end of the bracket 15, as shown in FIG. 2. Four parallel holes 53 are formed through the bracket 15 and are used for fastening the bracket 15 to the door 10 by means of screws extending through the holes 53.

Underneath the portion 48 of the bracket 15 is a cylindrically shaped tube receiving portion 55 integrally formed with the bracket. This tube receiving portion 55 does not extend all the way to the left-hand edge of the bracket 15, as is apparent from an examination of FIG. 2, and as is illustrated in dotted lines in FIG. 4. Thus, the left-hand end of the portion 48 (as viewed in FIG. 2) which has the hole 50 in it is shaped to extend into the space between the legs 21 and 26 of the bracket 13 when the assembly is made as illustrated in FIG. 1 and with the alignment most clearly shown in FIG. 4. In this position, the slot 50 is aligned with the holes 29 and 30 in the legs 21 and 26 of the bracket 13. When the screws through the holes 53 are tightened to fasten the bracket 15 to the door 10, the gap formed at the bifurcation 47 is squeezed together to tightly grip the outer tube 17 of the closer completing the assembly of the outer tube 17 to the bracket 15 which then acts as the end termination for the outer tube 17 of the closer mechanism.

Figure 3:
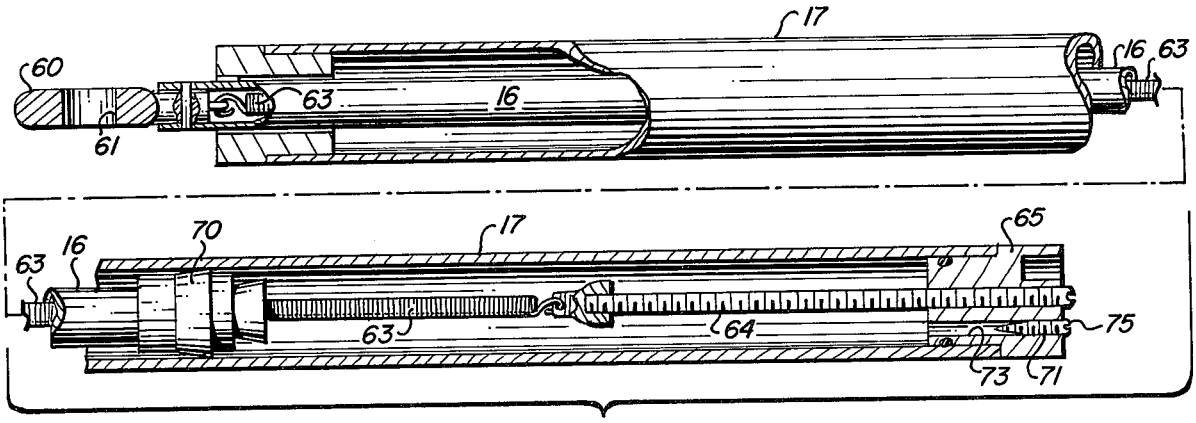
FIG. 3 is a partially cut-away sectional view taken along the lines 3—3 of FIG. 2.

The inner tube of the closer mechanism is closed or sealed in its left-hand end (as viewed in FIGS. 2 and 3) by a plug terminating in a flat latch engaging member 60 which has an elongated slot 61 formed through it. As seen most clearly in FIG. 4, the slot 61 in the member 60 is aligned with the holes 30 and 31 in the legs 26 and 27 when the door 10 is closed. The interconnection of the inner tube 16 and the outer tube 17 is essentially the same as in the above-mentioned U.S. Pat. No. 3,278,979 and is accomplished by means of a tension spring 63. This spring is attached at one end by a threaded retainer 64 to a plug 65 which closes the opposite end (the right-hand end as viewed in FIGS. 2 and 3) of the outer tube 17. The other end of the spring 63 extends through the inside of the hollow inner tube 16 and attaches to the end of the latch engaging member 60 which extends into the tube 16, as shown most clearly in FIG. 3. Thus, it is apparent that the tension spring 63 acts to close or collapse together the telescoping tubes 16 and 17. Adjustments of the tension of the spring 63 are effected by means of the threaded retainer 64 which extends through the cap (plug) 65 as shown in FIG. 3. Thus, the spring 63 may be tightened or loosened by use of a screw driver to rotate the threaded member 64 to change the effective length of the member 64 within the end of the tube 17.

A deformable suction washer 70, which may be of the type used in hand operated air pumps or the like, is attached to the right-hand end of the tube 16 inside the tube 17. The suction washer 70 is made of a generally deformable but resilient material such as rubber, leather, plastic or the like. The outer surface of the washer 70 slidingly engages the inner side of the outer tube 17. Since the washer is yieldable, air freely passes when the telescoped tubes 16 and 17 are opened or extended, but air pressure created as the tubes close to their collapsed position causes the suction washer to expand and effectively seal the space between the inner and outer tubes 16 and 17.

A bleeder valve 71 is positioned in communication with the interior of the outer tube 17 at the end closed by the plug 65. The bleeder valve 71 also could be placed in the assembly holding the washer 70 if desired. As illustrated in FIG. 3, however, the bleeder valve extends through the plug 65 and includes an aperture 73 closed by a threaded screw member 75. A slot or a groove in the threaded portion of the screw member 75 permits air to escape through the aperture 73 at the desired rate. By adjusting the screw 75, the rate of closing of the apparatus may be controlled by controlling the rate at which air is permitted to escape through the bleeder valve 71. The operation of such valves is conventional, and the valve may take on configurations other than the one specifically shown in FIG. 3.

Figure 4:
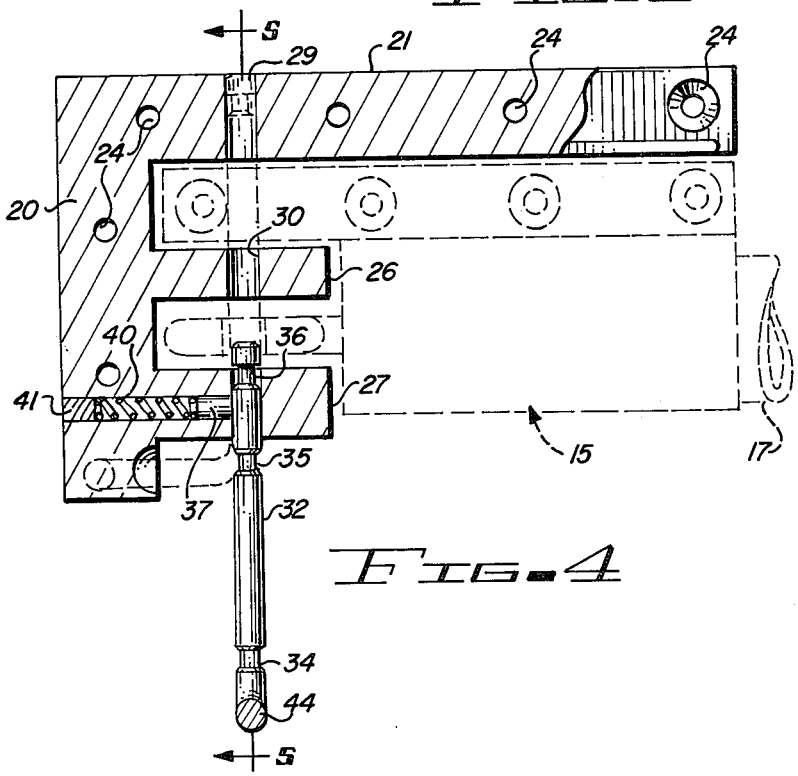
FIG. 4 is a sectional view taken along the lines 4—4 of FIG. 2.
Figure 5:
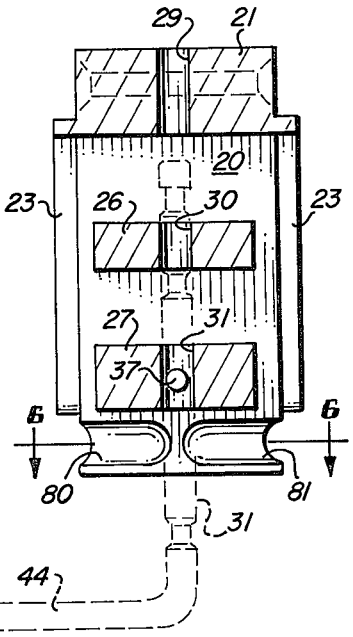
FIG. 5 is a sectional view taken along the lines 5—5 of FIG. 4.
Figure 6:
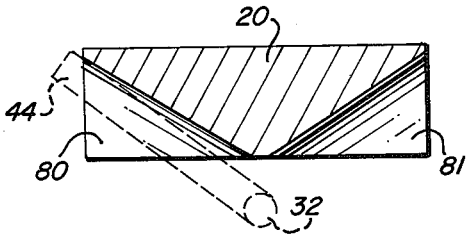
FIG. 6 is a sectional view taken along the lines 6—6 of FIG. 5.

When the brackets 13 and 15 are attached to the door frame and the door, respectively, as described above and as shown in FIG. 1, the locking bar 32 may be used to control the different modes of operation of the apparatus. When the door 10 is closed to align all of the parts of the brackets 13 and 15 and to align the latch engaging member 60 with the holes 30 and 31 in the legs 26 and 27 as shown in FIG. 4, any one of three different modes of operation of the sliding door may be effected. If the door is closed as described and the locking bar 32 is inserted all the way through to terminate in the leg 21 by placing the detent 34 in alignment with the follower 37, all of the parts are locked together. In this position, the door cannot be opened since the tube 17 is firmly locked in the bracket 15 which in turn is locked to the bracket 13 by means of the locking bar 32 passing through all three legs of the locking bar 13 as through the key slot 50 in the bracket 15. This is an effective slide bolt or dead bolt lock of the sliding door and prevents its opening.

Next, assume that the door 10 is to be unlocked and is to be operated using the action of the closer comprised of the inner and outer tubes 16 and 17 to automatically close the door, at a rate controlled by the setting of the bleeder valve 71, each time the door is opened. To accomplish this, the locking bar 32 is withdrawn to its second position causing the detent 35 to be aligned with the follower 37. In this position, the extension on the bracket 15 is permitted to freely pass in and out of the opening between the legs 21 and 26 of the bracket 13. When the locking bar 32, however, is moved to this position with the door closed, it extends through the slot 61 in the latch engaging member 60 to hold the latch engaging member in place. Thus, when the door is moved to the right as viewed in FIGS. 2, 3 and 4 (or to the left as viewed in FIG. 1) the end of the inner tube 16 is held in place by the locking bar 32 to cause the relative extension of the closure member as illustrated in FIG. 1 against the bias of the tension spring 63, stretching the tension spring. When the door is released, the tension spring pulls the two tubes 16 and 17 together to return it to the closed position illustrated in dotted lines in FIG. 4.

The third mode of operation of the sliding door 10 using the locking mechanism illustrated in FIGS. 2 and 4 is with the locking bar 32 in its lowermost position. In this position, the detent 36 is aligned with the follower 37; and the spaces between all of the three legs 21, 26 and 27 of the bracket 13 are clear of or free of the locking bar 32. In this position, there is nothing to hold the latch engaging member 60 in place when the door is opened; so that the latch engaging member 60 moves right along with the movement of the bracket 15 when the door is open. Thus, the door functions in its conventional fashion as if the closer member were not present. In this mode of operation the door can be left open in any partially open or fully open position, without the necessity of propping it open with a chair or using some other type of apparatus or device to present the closer member from reclosing the door.

At any time that resumption of the operation of the closer member is desired, the door merely is fully closed, the locking bar 32 is moved upwardly as viewed in FIG. 4 to its second position to pass through the slot 61 in the latch engaging member 60, and operation of the door under the control of the closer mechanism once more is resumed. Similarly, a return to the fully locked position is accomplished in a similar manner by closing the door and then inserting the locking bar 32 to its uppermost vertical position, it then can be rotated in either direction (depending upon whether the bracket 13 is mounted for a left-hand or right-hand closing door) into one of the two slots which then retain the end of the handle 44 and prevent the bar 32 from accidentally dropping downwardly. The detent 37 should be sufficient to accomplish this purpose but the additional security provided by the slots 80 and 81 mitigates against any possible accidental dropping of the bar 32.

The foregoing description has been limited to a preferred embodiment of the invention which, however, is considered to be merely illustrative of the principles of the invention and not limiting of the true scope of the invention. Various modifications and equivalent applications of the concepts of this invention will occur to those skilled in the art without departing from the true scope of the invention as set forth in the following claims.

I claim:

1. In a sliding door closure having inner and outer mutually telescoping tubes movable between closed and extended positions, and a spring attached under tension to bias the telescoping tubes to their closed position, an improvement including in combination:

a first bracket for attachment to the corner of a frame in which a sliding door slides;

a second bracket for attachment to a sliding door and adapted to be secured adjacent one end of the outer tube of said closure;

a latch engaging member on the inner tube of said closure extending beyond said one end of the outer tube and having latch engaging means thereon; and locking means for selectively (1) interlocking at least said first and second brackets together, (2) interlocking at least said first bracket and said latch engaging means of said latch engaging member together and (3) permitting movement of said second bracket and said latch engaging member relative to said first bracket.

2. The combination according to claim 1 wherein said first and second brackets each are formed as unitary molded parts.

3. The combination according to claim 1 wherein said locking means includes a locking bar movable to first, second and third positions; and said first and second brackets and said latch engaging means of said latch engaging member each include portions for engagement by said locking bar at different positions thereof for effecting the first, second and third selective operations of said locking means.

4. The combination according to claim 1 wherein the spring is attached under tension to the other end of the outer tube and to the inner tube, and said second bracket is secured to the outer tube at said one end thereof and is attached to the edge of the sliding door at the upper corner thereof adjacent the corner of the frame in which said first bracket is attached.

5. The combination according to claim 1 wherein said locking means comprise a sliding locking bar capable of movement to three positions for selectively effecting (1) the interlocking of said first and second brackets, (2) the interlocking of said first bracket and the latch engaging means of said latch engaging member and (3) permitting said movement of said second bracket and said latch engaging member relative to said first bracket.

6. The combination according to claim 5 wherein said locking bar has a handle extension thereon to facilitate the operation thereof.

7. The combination according to claim 5 wherein said sliding bar is held captive in said first bracket and is movable to three different positions therein.

8. The combination according to claim 7 wherein said first bracket is of a generally E-shaped configuration having first, second and third horizontally extending arms and said locking bar is movable vertically through said arms; said second bracket has an extension adapted for movement between the center one and one of the other arms of said first bracket; and the latch engaging means of said latch engaging member is adapted for movement between the center one and one of the other arms of said first bracket when the door to which said second bracket is secured is moved to the closed position for selective engagement by said locking bar.

9. The combination according to claim 8 wherein the extension of said second bracket has a hole through it and is adapted for movement between the center leg and the upper leg of said first bracket; the latch engaging means of said latch engaging member is adapted for movement between the center leg and the lower leg of said first bracket and comprises an extension on the latch engaging member having a hole therethrough which aligns with holes through the three legs of said first bracket when the door to which said second bracket is secured is closed; so that said locking bar (1) in the first position thereof extends all the way through all of the holes in all of the legs of said first bracket, the hole in the extension on said second bracket, and the hole in the locking means of said latch engaging member for interlocking said first and second brackets and said latch engaging member together, (2) in the second position thereof extends through the lower leg of the first bracket, the hole in the latch engaging means of the extension on the latch engaging member, and the center leg of said first bracket means to interlock said first bracket and the latch engaging member while freeing said second bracket for movement relative to said first bracket and (3) in the third position thereof extends into and is held captive by the lower leg of the first bracket to release both the second bracket and the latch engaging member for relative movement with respect to said first bracket.

* * * * *